US005860410A

United States Patent [19]

Hollingsworth, Jr.

[11] Patent Number: 5,860,410

[45] Date of Patent: Jan. 19, 1999

[54] PORTABLE STAND FOR MULTIPLE FUEL-POWERED APPLIANCES

[76] Inventor: Colin Hollingsworth, Jr., Rte. 3, Box 448, Pine City, Minn. 55063

[21] Appl. No.: 862,548

[22] Filed: May 23, 1997

[51] Int. Cl.[6] ..... F24C 3/08

[52] U.S. Cl. ..... 126/40; 126/50; 126/255; 362/160

[58] Field of Search ..... 126/40, 50, 92 R, 126/229–233, 209, 255–260, 38, 235, 236; 362/190, 160; 431/344

[56] References Cited

U.S. PATENT DOCUMENTS

| | | | |
|---|---|---|---|
| 189,787 | 4/1877 | Rothschild, Jr. | 126/40 |
| D. 292,830 | 11/1987 | Yuen . | |
| 780,022 | 1/1905 | Bryan | 126/40 |
| 973,867 | 10/1910 | Johnson, Jr. | 126/236 |
| 3,140,740 | 7/1964 | Lagreid et al. . | |
| 4,149,225 | 4/1979 | Barson . | |
| 4,791,538 | 12/1988 | Prest . | |
| 5,016,611 | 5/1991 | Lai . | |
| 5,038,749 | 8/1991 | Jerry et al. . | |
| 5,038,819 | 8/1991 | Sutphen . | |
| 5,307,798 | 5/1994 | Overmars, Sr. . | |
| 5,353,694 | 10/1994 | Fins . | |
| 5,361,798 | 11/1994 | Beckstrom . | |

*Primary Examiner*—James C. Yeung
*Attorney, Agent, or Firm*—Patterson & Keough, P.A.

[57] ABSTRACT

A portable stand supports both a lighting device and a heating device, such as a lantern and a space heater or stove, and directs fuel to these devices from a single source. The lighting device and heating device are both quickly and easily mountable on the stand, enabling easy assembly and one-piece transport to an outdoor site where both heat and illumination are desired. The stand preferably is a unitary assembly with easy connection and disconnection of fuel lines, and is compact and allows close mounting against a wall or other structure, such as the wall of an ice-fishing house. Embodiments of the invention have application to fishing, particularly ice fishing, as well as to other outdoor activities such as photography, maintenance, farming, construction and utility work, to name a few.

21 Claims, 3 Drawing Sheets

100
90
80
65
70
60
10
50
145
48
35
38
40
45
40
20
30
34
32

PORTABLE STAND FOR MULTIPLE FUEL-POWERED APPLIANCES

BACKGROUND OF THE INVENTION

1. Field of the Invention

The invention relates to support stands for fuel-powered appliances, and more particularly, to support stands that direct fuel from at least one fuel source to multiple appliances, such as a lantern and/or a "sunflower"-type heater.

2. Description of Related Art

Persons who enjoy fishing and other outdoor activities in cold weather or during nighttime hours often desire some means of illuminating their immediate surroundings, and generating heat for warmth and/or cooking purposes. Of course, there are a number of illumination devices for outdoor use, including various kerosene and other types of lanterns. A variety of heaters, stoves, and other heating/cooking devices are also readily available, using a wide variety of fuel types. The Coleman Company, for example, makes a number of products for outdoor use, including lanterns, heaters and stoves.

These devices are very effective and therefore quite popular. However, generally speaking, such devices require their own, independent fuel supply, requiring the user to haul multiple fuel tanks or fill reservoirs of the devices on a regular basis. In addition to the dangers presented by leakage and spillage, the user is subjected to the somewhat burdensome task of hauling the individual fuel supplies and/or various reservoir-filling accessories to the site where the outdoor activity will occur, which often can be a significant distance from the vehicle, house, or other base of operations.

One possible approach to address at least some of these problems is disclosed in U.S. Pat. No. 5,361,798 to Beckstrom. This patent discloses a propane distribution pole, mounted on a base and having hose fittings connectable to a propane-fired stove/burner and to a propane-fired lantern. The disclosed pole also includes a hose connection to an external propane tank, which can be remotely located from the user, e.g. outside an ice-fishing house. The disclosed pole has a sealed plug at its bottom, where it threadedly engages the base, to reduce the likelihood of propane leakage.

The apparatus disclosed in Beckstrom, however, requires the user to separately haul the pole, base, burner/heater, and/or lantern to the ice-fishing house or other outdoor destination. Additionally, the disclosed distribution pole includes a plurality of shut-off valves that can be easily bumped and thus cause potentially dangerous propane leakage. The disclosed pole also is centered on its base, taking up a substantial amount of space. This can be disadvantageous, especially in closely confined areas such as ice-fishing houses. Further, because at least the burner can be placed anywhere in relation to the user and the pole, the likelihood of accidentally bumping into and knocking over the burner, and/or burning oneself, is significant.

U.S. Pat. No. 3,140,740 to Lagreid also shows a separate fuel tank for supplying both a burner and a lantern. However, as with the Beckstrom patent, a user of this arrangement must separately haul the lantern, burner, and/or fuel tank to the site of the outdoor activity. Further, a user of the disclosed device must contend with multiple, extended lengths of hose, running from the propane tank to the lantern and again from the propane tank to the burner. Additionally, for maximum illumination, the lantern would have to be mounted on an independent support. The user might very well place the lantern on an unstable object, increasing the danger of the lantern falling over, breaking, and potentially causing a hazardous propane leak. Further, because the lantern and burner can be placed anywhere in relation to the user, the likelihood of accidentally bumping into and knocking over these devices, and/or burning oneself, is significant.

Therefore, although providing some convenience to users, the above-described devices have certain disadvantages that are unaddressed in the prior art.

SUMMARY OF THE INVENTION

To remedy the above and other disadvantages, a portable stand according to the invention supports both a lighting device and a heating device, and directs fuel from a fuel source to these devices, with increased safety, stability, and efficiency. A stand according to one embodiment of the invention includes a base frame, a heating-device frame disposed above the base frame to receive a heating device, and an upstanding section extending generally upwardly from the base frame. The upstanding section is constructed to support a lighting device above the heating-device frame, and preferably includes at least one upstanding support member and at least one fuel line. The fuel line is supported by the upstanding support member and is constructed to receive fuel from a fuel source, direct fuel toward the heating device, and direct fuel toward the lighting device.

An upper section of the heating-device frame extends generally parallel to the base frame and generally perpendicular to the upstanding section. According to one embodiment, the heating-device frame further includes at least two uprights extending from the upper section downwardly to the level of the base frame. The base frame preferably is of a geometric shape, such as a polygonal or septagonal shape, and the upper section of the heating-device frame is of a shape that is substantially one-half the shape of the base frame. Embodiments of the invention are designed to use a small amount of space while providing maximum stability. For example, embodiments of the invention can be backed against the wall of an ice-fishing house or other structure.

The upstanding section includes at least one retaining member for holding the fuel line in substantially fixed relationship to the upstanding support member. An upper end of the fuel line is constructed to receive and support the lighting device, preferably out-of-contact with the upstanding support member. The upstanding support member can comprise a pair of substantially tubular members, with a cross-member connecting them at their upper ends for enhanced stability.

The stand further includes a fuel coupling at a lower portion of the fuel line, the coupling being e.g. a T-coupling or a T-coupling and elbow-coupling combination, for connecting preferably a single fuel source to the fuel line. The coupling also directs fuel from the fuel source toward the lighting device and toward the heating device.

The heating-device frame is preferably constructed to substantially fixedly mount the heating device to the stand, preventing tipping, reducing the likelihood of accidental bumping, and making storage easier, for example. Additionally, the upstanding section is preferably disposed at an outer edge of the base frame, so that the stand can be placed near the wall of an ice-fishing house or other structure.

These and other features of the invention in its various embodiments will be apparent from the remainder of the application.

BRIEF DESCRIPTION OF THE DRAWINGS

Embodiments of the invention will be described with reference to the figures, in which like reference numerals denote like elements, and in which.

DETAILED DESCRIPTION OF PREFERRED EMBODIMENTS

Figure 1:
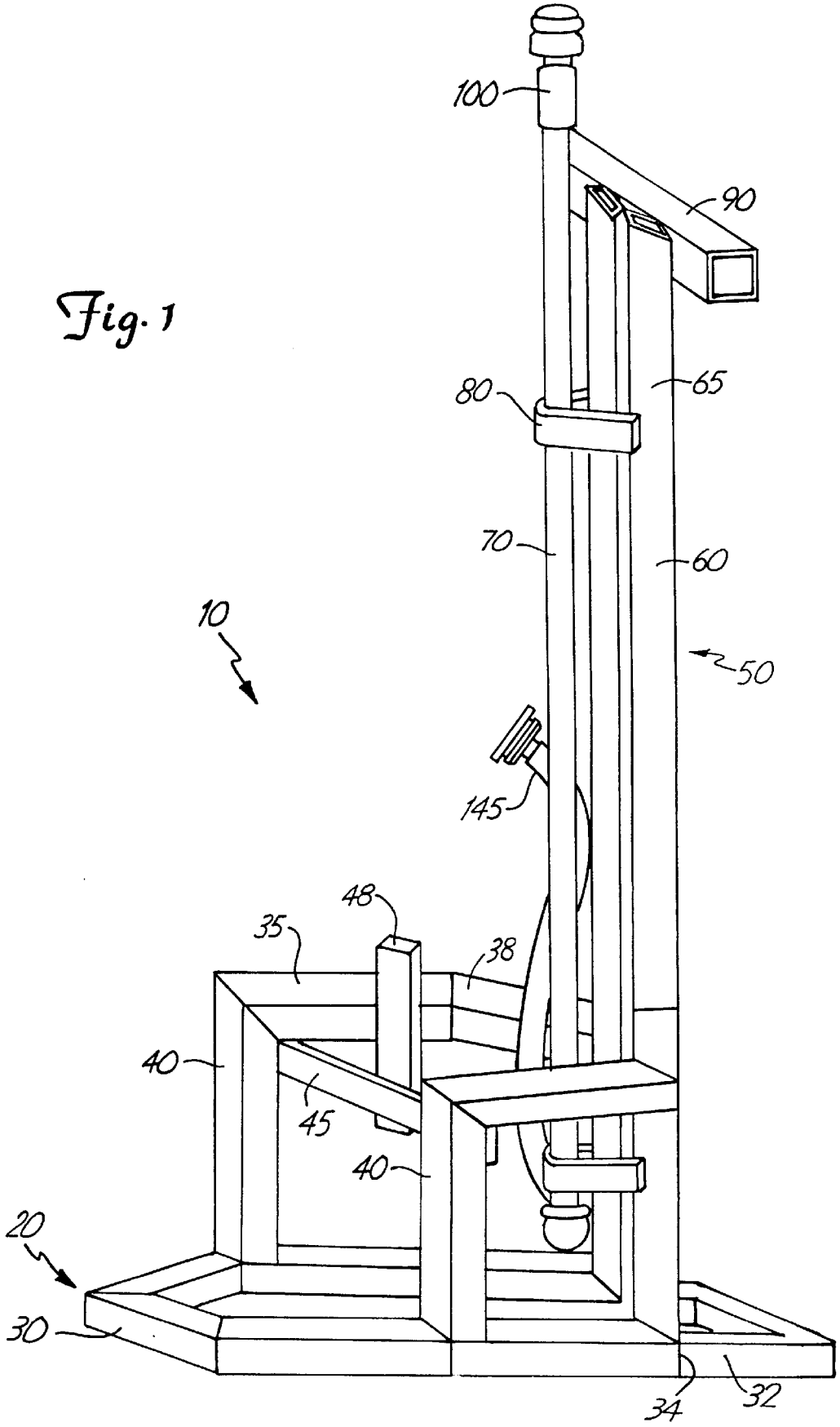
FIG. 1 is a perspective view showing a stand according to an embodiment of the invention.

Embodiments of the invention are particularly useful during fishing activities, especially ice-fishing activities in which an ice house is used. Embodiments of the invention also have application to open-ice fishing and boat-fishing situations, however. Additionally, embodiments of the invention will appeal to individuals involved in a wide variety of outdoor activities, for example campers, photographers, bird-watchers and other naturalists, professional and amateur astronomers, etc. Further, embodiments of the invention have industrial application, for example at construction sites, by utility crews, and in farming situations. Therefore, although certain embodiments of the invention particularly apply to fishing, the invention is by no means limited to these embodiments.

Turning to FIGS. 1–4, portable stand 10 according to the invention includes base frame 20, which preferably is of a polygonal shape having a plurality of connected sides 30. According to the illustrated embodiment, base frame 20 is a septagon, but of course a wide variety of polygonal, circular, oval, square, rectangular, and other geometric shapes are contemplated according to the invention.

Base frame 20 optionally includes a rearwardly, substantially horizontally extending subframe 32, which preferably is substantially U-shaped and preferably includes a tubing reinforcement section 34 attached to rearmost sides 30 of base frame 20. This provides enhanced support for upstanding section 50, as will be described, and promotes greater stability in the overall apparatus.

Stand 10 also includes frame 35, which according to one embodiment is a heating-device frame for supporting and/or receiving a heating device. Frame 35 can receive a wide variety of heating and/or cooking appliances, such as "sunflower"-type heaters. Frame 35 can also receive other fuel-powered appliances, according to the invention, preferably drawing liquid or gaseous fuel, such as propane, from a single external tank or multiple external tanks.

As illustrated, heating-device frame 35 includes an upper section 38, extending generally parallel to base frame 20 and generally perpendicular to an upstanding section 50, which will be described. Heating-device frame 35 is supported a predetermined distance above base frame 20 and for greater stability preferably includes at least two uprights 40 extending from upper section 38 generally downwardly to the level of base frame 20.

Heating-device frame 35 also preferably includes cross-member 45, extending across upper section 38 from side-to-side. Supported by cross-member 45 is plate member 48, for securing the heating device to the frame, for example in a manner described with respect to FIG. 6, below. As will be appreciated by those of ordinary skill in the art, heating-device frame 35 thus is constructed to substantially fixedly mount a heating device to the stand.

As mentioned above, portable stand 10 also includes upstanding section 50, extending generally upwardly from base frame 20, as shown. Upstanding section 50 includes at least one support member 60, which, according to the illustrated embodiment, is in the form of two preferably substantially square, hollow tubes. Stand 10 further comprises cross-member 90, which connects tubular members 60 together at their upper ends for enhanced strength and stability.

Upstanding section 50 also includes fuel line 70, supported in substantially fixed relationship with support member 60 by substantially U-, V-, or other-shaped brackets or retaining members 80. A square or otherwise angled shape of tubes 60 presents angled surfaces 65, which provide excellent support for connecting retaining members 80.

An upper end of fuel line 70 includes coupling 100, which is constructed to receive and support a lighting device, such as a liquid-fuel or gas-fired lantern. The lighting device is screwed onto coupling 100, according to one embodiment. For maximum illumination and to reduce the likelihood of damage to the lighting device, coupling 100 supports the lighting device above and out-of-contact with support members 60. Embodiments of stand 10 also do not block light in any position in which the stand may be turned, for example about a substantially vertical axis. By elevating coupling 100, the heating device supported by heating-device frame 35 can be turned away from a user with no loss of light. For purposes of this description, the term "above" should be interpreted to include a directly overlying relationship between the lighting device and the support members 60, as well as an offset relationship in which the lighting device is merely disposed at a higher elevation than support members 60.

Fuel line 70 of stand 10 according to the invention also includes fuel coupling 110, disposed at a lower portion of fuel line 70. Fuel coupling 110 is preferably a T- or elbow-shaped coupling with a base leg having a base port 120 and two side legs having side ports 130, 140. Coupling 110 is constructed to connect preferably a single fuel source via port 130 or 140 to fuel line 70, although multiple fuel sources also can be connected. Further, coupling 110 is connectable at the other of ports 130, 140 to a hose 145 leading to a heating device, or to a heating device directly, as further described below. Port 120 in coupling 110 of fuel line 70 directs fuel from the fuel source toward the lighting device at coupling 100, and port 130 or 140 directs fuel toward the heating device.

Figure 2:
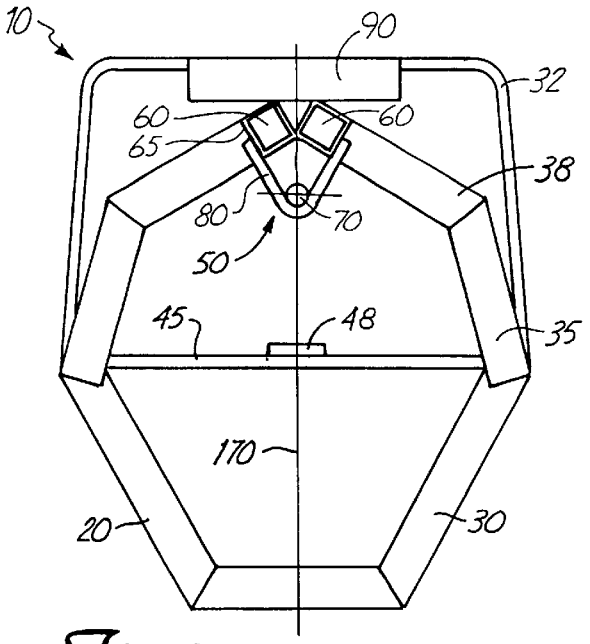
FIG. 2 is a plan view of a stand according to an embodiment of the invention.

As shown in FIG. 2, upstanding section 50 is disposed at substantially an outer edge, and in the illustrated embodiment a rearward edge, of base frame 20. This allows more efficient use of space in a confined environment such as an ice-fishing house, because upstanding section 50 can be placed more closely adjacent a wall, for example. Substantially U-shaped member 32 provides additional stability to stand 10, so that any instability potentially caused by the off-center placement of upstanding section 50 is significantly reduced, if not entirely eliminated. Substantially U-shaped member 32 provides additional stability when stand 10 is attempted to be tipped back, during cooking, for example. Tubing reinforcement section 34 also provides enhanced stability to the intersection of support members 60 and base frame 20.

Figure 3:
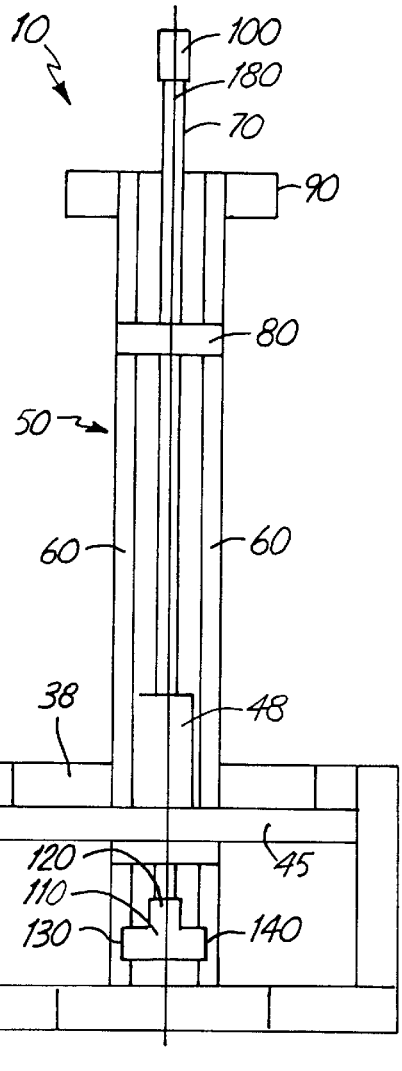
FIG. 3 is a front view of the FIG. 2 stand.
Figure 4:
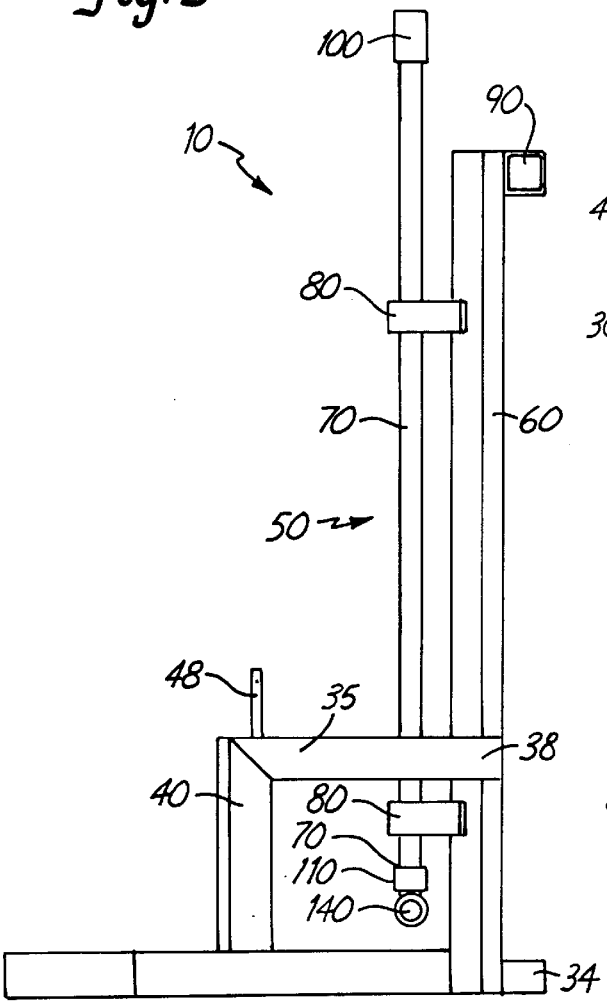
FIG. 4 is a side view of the FIG. 2 stand.

Also as shown in FIG. 2, stand 10 is substantially symmetrically disposed about horizontal centerline 170. This provides a very aesthetically pleasing appearance, more so than with many prior art devices. Additionally, as shown in FIG. 3, stand 10 is substantially symmetrically disposed about vertical center line 180 as well.

Figure 5:
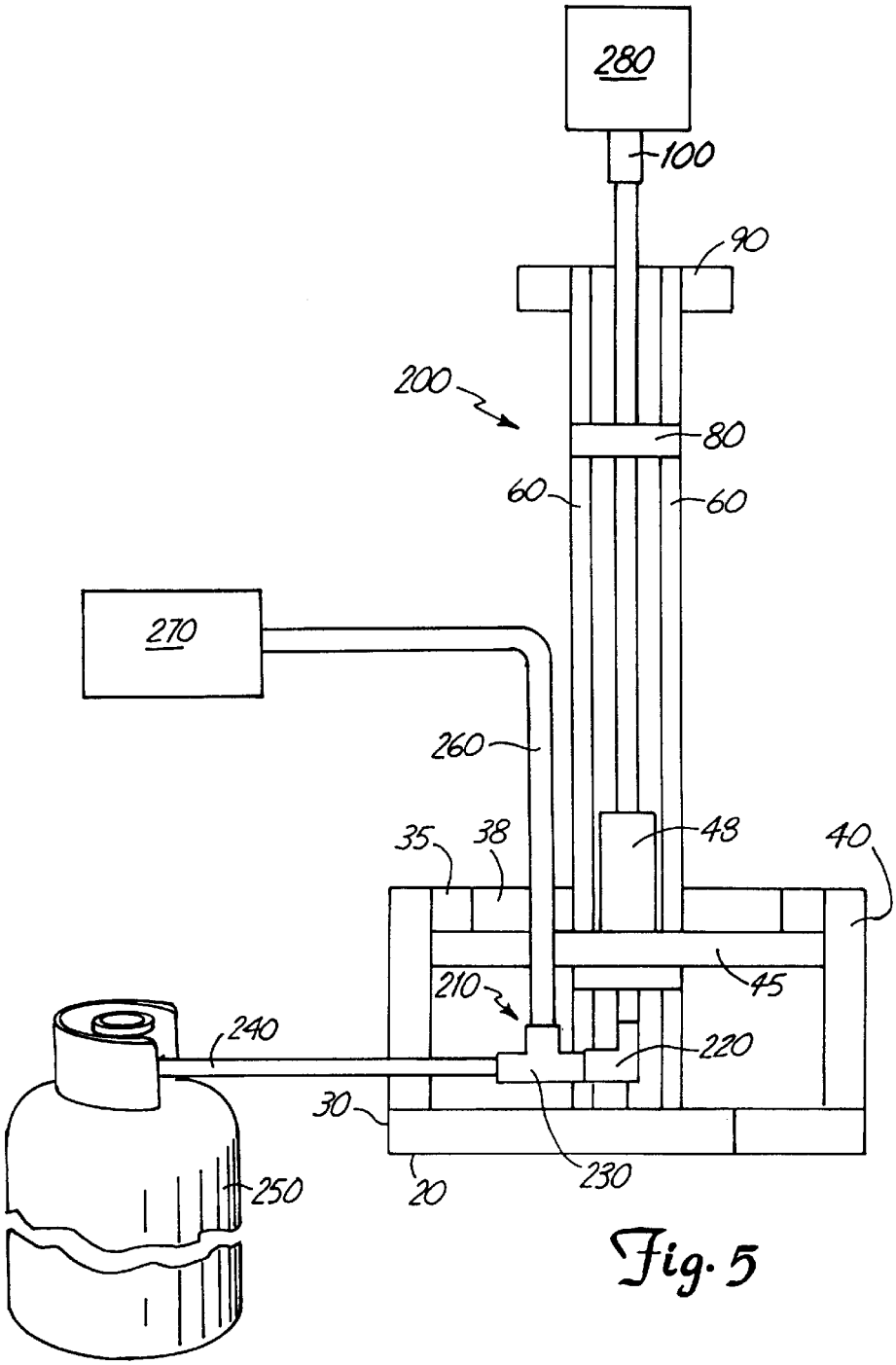
FIG. 5 is a front view of a stand according to an additional embodiment of the invention.

Turning to the FIG. 5, an alternate stand embodiment 200 is shown. Stand 200 includes an combination fuel coupling 210, composed of an elbow-coupling 220 and T-coupling 230 joined together. FIG. 5 also illustrates single fuel source 250, for example a propane tank, which supplies fuel to stand 200 by a hose or other-type fuel line 240. Propane or other fuel travels from source 250 along line 240 toward and into coupling 210, which then directs fuel along line 260 toward and into heating device or other appliance 270. It should be noted that heating device 270 is illustrated schematically and not necessarily in its in-use position, which preferably is within heating-device frame 35. Combination coupling 210 also directs fuel from source 250 toward lighting device 280, again schematically illustrated, via fuel line 70. Elbow-coupling 220 and T-coupling 230 of combination coupling 210 can be jointly formed of one-piece construction, or can be two separate pieces joined together, as illustrated.

Hoses 240, 260 are designed for easy connection and disconnection to combination coupling 110 according to the invention, providing quick and easy set-up at the outdoor site. Alternatively, the hoses can remain connected to source 250, heating device 270 and/or coupling 110/210 during travel to the site, allowing instant set-up. Because heating device 270 and/or lighting device 280 also can remain mounted on or otherwise fixedly attached to the stand, ease of transport and set-up is assured. Transport and set-up are also facilitated because the user need not separately haul fuel source(s), lighting device, heating device, and support structure. Additionally, for even greater ease of transport, the portable stand according to the invention can be secured to fuel source 250, for example by a strap extending around the circumference of fuel source 250. Then, by providing fuel source 250 with a carrying handle, light, heat, support and fuel can all be carried to the remote site with one hand. Additionally, as will be apparent to those of ordinary skill, the entire combined device, or the entire without fuel source 250, can easily be hung in a storage shed or other facility when not in use, in a compact, one-piece configuration.

Figure 6:
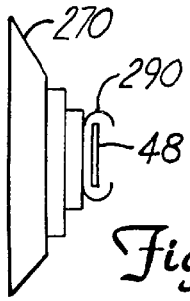
FIG. 6 is a top view showing a heating device attached to a stand according to an embodiment of the invention.

As shown in FIG. 6, heating device 270, for example, a "sunflower"-type heater, includes a bent piece of e.g. steel 290 or other material, which slides over plate number 48 secured to cross-number 45, as described above.

The stand according to the invention can also be provided with a strap or other means for mounting to another support while in-use, for example to a boat seat, tree limb, or other support.

A wide variety of materials are contemplated for use according to the invention. According to one embodiment, one-inch square cross-sectional steel tubing is used for base support 20, heating-device frame 35 and upstanding supports 60. Cylindrical steel tubing can be used for fuel line 70, according to one embodiment. Couplings 100, 110, 210 can be formed of brass, steel or other suitable material. Cross-member 45 and plate member 48 can be formed of steel strip stock, for example. Alternatively, aluminum, steel/aluminum combinations, or other preferably lightweight metallic materials, or plastic-type materials, can be used. The invention is not limited to these specific examples, however.

According to one embodiment, all of the individual elements of a stand according to the invention are formed in one-piece construction, promoting strength, reducing manufacturing costs, and reducing on-site assembly time and thus facilitating ease of use. Alternatively, multiple-piece construction might be desirable, for example to adjust the height at which fuel line 70 supports the lighting device off the ground. Support member 60 and/or fuel line 70 can be extendable, for example by inserting additional extension or coupling devices.

According to one embodiment, base frame 20 is about 10-½ inches long by about 11-¼ inches wide, but a wide variety of sizes are contemplated according to the invention to suit particular applications.

Thus, embodiments according to the invention provide a number of advantages over prior art devices. The small storage size, ease of use and transport, convenience and portability achievable with embodiments of the invention provide significant advantages over the prior art. When not in use, the product consumes relatively little space, enabling easy transport in a pick up truck bed or the cargo area of a van or similar vehicle. As mentioned earlier, embodiments of the invention can be used to supply heat and illumination and also can be used for cooking, thus eliminating the need to haul a camp stove, a lantern, and a distinct fuel source, e.g. white-gas fuel or other fuel. Embodiments of the invention enable campers, fisherman, and other outdoorspeople to provide light, heat and comfort easily and portably, and thus provide significant advantages.

Various modifications and alternatives will be apparent to those of ordinary skill upon reading the above disclosure. For example, a stand according to the invention can also be used to support multiple lighting devices and multiple heating devices, and/or to draw fuel from multiple fuel sources. A stand according to the invention can also be used to support and run a single lighting device, heating device, or other appliance. Various materials and material configurations can be used instead of steel; for example high-strength plastic could also be used for at least some of the structural components. A seat can be fastened to the top of the propane tank, eliminating the necessity of carrying a camp stool or carrying/emptying an extra bucket. The heating device according to the invention can be used as a space heater and/or a burner for cooking. Spring-loaded pins could be used connect various elements according to the invention together, for example heating device 270 or lighting device 280 to their respective couplings, or support members 60 to base frame 20 although this might tend to compromise safety. Various fuel sources and types of fuel are also contemplated. Embodiments of the invention can be hung from a tent roof, shed wall, etc. Features depicted in the various figures can be combined together and or selectively eliminated, as desired. Various other changes and modifications will apparent to those of ordinary skill.

What is claimed is:

1. A portable stand for supporting both a lighting device and a heating device and for directing fuel from a fuel source to both the lighting device and the heating device, the stand comprising:

a base frame;

a heating-device frame supported by and disposed above the base frame, the heating-device frame being constructed to receive a heating device; and an upstanding section supported by and extending generally upwardly from the base frame and being constructed to support a lighting device above the heating-device frame, the upstanding section being supported by the base frame in substantially fixed, substantially immovable relationship with respect thereto, the upstanding section including:

at least one upstanding support member; and at least one fuel line supported by the upstanding support member, the fuel line being constructed to receive fuel from a fuel source, direct fuel toward the heating device received by the heating-device frame, and direct fuel toward the lighting device supported by the upstanding section.

2. The portable stand of claim 1, wherein the heating-device frame comprises an upper section extending generally parallel to the base frame and generally perpendicular to the upstanding section.

3. The portable stand of claim 2, wherein:

the base frame is of a polygonal shape as viewed from above; and the upper section of the heating-device frame as viewed from above is substantially one-half of the polygonal shape of the base frame.

4. The portable stand of claim 2, wherein the heating-device frame further comprises at least two uprights extending from the upper section of the heating-device frame generally downwardly to the level of the base frame.

5. The portable stand of claim 4, wherein the heating-device frame further comprises a cross member extending between the at least two uprights, and a further member constructed to extend upwardly from the cross member to contact and support the heating device.

6. The portable stand of claim 1, wherein the upstanding section comprises at least one retaining member for holding the fuel line in substantially fixed relationship to the upstanding support member.

7. The portable stand of claim 1, wherein an upper end of the fuel line is constructed to receive and support the lighting device, such that the stand can be rotated about a substantially vertical axis in any direction without blocking light from the lighting device.

8. The portable stand of claim 7, wherein the upper end of the fuel line is constructed to receive and support the lighting device above and out-of-contact with the upstanding support member.

9. The portable stand of claim 1, wherein:

the upstanding support member comprises a pair of substantially tubular members having upper ends; and the stand further comprises a cross-member connecting the tubular members together at their upper ends to stabilize the tubular members.

10. The portable stand of claim 1, further comprising:

a fuel coupling disposed at a lower portion of the fuel line, the coupling being constructed to connect a single fuel source to the fuel line and to connect the heating device to the fuel line, the coupling directing fuel from the fuel source toward the lighting device and the heating device.

11. The portable stand of claim 10, wherein the fuel coupling comprises a T-coupling or an elbow-coupling.

12. The portable stand of claim 10, wherein the fuel coupling terminates the fuel line at the lower portion of the fuel line.

13. The portable stand of claim 1, wherein the heating-device frame is constructed to substantially fixedly mount the heating device to the stand.

14. The portable stand of claim 1, wherein the upstanding section is substantially immovably disposed at substantially an outer edge of the base frame; further wherein the upstanding section is constructed to always support the lighting device over the base frame.

15. The portable stand of claim 1, wherein the upstanding section directly contacts both the heating-device frame and the base frame.

16. The portable stand of claim 1, wherein the heating-device frame is constructed to support the heating device such that the heating device extends above the highest point of the heating-device frame.

17. An apparatus for directing fuel from a fuel source to two fuel-powered appliances, the apparatus comprising in combination:

a first fuel-powered appliance;

a second fuel-powered appliance;

a stand, comprising:

a base frame;

a receiving frame supported by and disposed above the base frame, the receiving frame being constructed to receive and substantially fixedly mount the first appliance; and an upstanding section supported by and extending generally upwardly from the base frame and being constructed to support the second appliance above the receiving frame, the upstanding section directly contacting both the receiving frame and the base frame, the upstanding section including:

at least one upstanding support member; and at least one fuel line supported by the upstanding support member, the fuel line being constructed to receive fuel from a fuel source, direct fuel toward the first appliance received by the frame, and direct fuel toward the second appliance supported by the upstanding section.

18. The apparatus of claim 17, wherein the first appliance is a heating device and the second appliance is a lighting device.

19. The apparatus of claim 17, further comprising a fuel source coupled to the fuel line.

20. A portable stand for supporting both a lighting device and a heating device and for directing fuel from a fuel source to both the lighting device and the heating device, the stand comprising:

a base frame, the base frame being of a polygonal shape as viewed from above;

a heating-device frame supported by and disposed above the base frame, the heating-device frame being constructed to receive a heating device, the heating-device frame comprising an upper section, the upper section as viewed from above being substantially one-half of the polygonal shape of the base frame; and an upstanding section supported by and extending generally upwardly from the base frame and being constructed to support a lighting device above the heating-device frame, the upstanding section being supported by the base frame in substantially fixed, substantially immovable relationship with respect thereto, the upstanding section including:

at least one upstanding support member; and at least one fuel line supported by the upstanding support member, the fuel line being constructed to receive fuel from a fuel source, direct fuel toward the heating device received by the heating-device frame, and direct fuel toward the lighting device supported by the upstanding section.

21. A portable stand for supporting both a lighting device and a heating device and for directing fuel from a fuel source to both the lighting device and the heating device, the stand comprising:

a base frame;

a heating-device frame supported by and disposed above the base frame, the heating-device frame being constructed to receive a heating device; and an upstanding section supported by and extending generally upwardly from the base frame and being constructed to support a lighting device above the heating-device frame, the upstanding section including:

at least one upstanding support member; and at least one fuel line supported by the upstanding support member, the fuel line being constructed to receive fuel from a fuel source, direct fuel toward the heating device received by the heating-device frame, and direct fuel toward the lighting device supported by the upstanding section;

wherein the upstanding support member comprises a pair of substantially tubular members having upper ends;

further wherein the stand further comprises a cross-member connecting the tubular members together at their upper ends to stabilize the tubular member.

* * * * *